US006851237B2

(12) United States Patent
Niese et al.

(10) Patent No.: US 6,851,237 B2
(45) Date of Patent: Feb. 8, 2005

(54) FLOORBOARD WITH COMPRESSION NUB

(75) Inventors: Michael Niese, Cincinnati, OH (US); Paul Elliott, Salem, IN (US)

(73) Assignee: Robbins, Inc., Cincinnati, OH (US)

( * ) Notice: Subject to any disclaimer, the term of this patent is extended or adjusted under 35 U.S.C. 154(b) by 0 days.

(21) Appl. No.: 10/430,960

(22) Filed: May 6, 2003

(65) Prior Publication Data

US 2003/0196397 A1 Oct. 23, 2003

Related U.S. Application Data

(63) Continuation of application No. 09/804,207, filed on Mar. 12, 2001, now abandoned, which is a continuation of application No. PCT/US99/20835, filed on Sep. 10, 1999.

(60) Provisional application No. 60/099,829, filed on Sep. 11, 1998.

(51) Int. Cl.[7] ..... E04B 5/02; E04F 15/14

(52) U.S. Cl. ..... 52/480; 52/392; 52/403.1; 52/592.1

(58) Field of Search ..... 52/390–392, 480, 52/539, 551, 558, 403.1, 592.1, 598.1, 511; 403/381, 364

(56) References Cited

U.S. PATENT DOCUMENTS

| | | | | | |
|---|---|---|---|---|---|
| 713,577 | A | * | 11/1902 | Wickham | 52/539 |
| 938,430 | A | * | 10/1909 | McQuern | 52/591.5 |
| 1,764,331 | A | * | 6/1930 | Moratz | 52/403.1 |
| 1,859,667 | A | | 5/1932 | Gruner | |
| 2,021,341 | A | * | 11/1935 | Ward | 52/233 |
| 3,807,113 | A | * | 4/1974 | Turner | 52/539 |
| 4,095,913 | A | | 6/1978 | Pettersson et al. | |
| 4,292,776 | A | * | 10/1981 | MacDonald | 52/394 |
| 4,930,280 | A | * | 6/1990 | Abendroth | 52/403.1 |
| 5,570,554 | A | * | 11/1996 | Searer | 52/539 |
| 5,906,082 | A | * | 5/1999 | Counihan | 52/403.1 |
| 5,928,735 | A | * | 7/1999 | Padmanabhan et al. | 428/33 |
| 6,418,683 | B1 | * | 7/2002 | Martensson et al. | 52/282.1 |

FOREIGN PATENT DOCUMENTS

| | | |
|---|---|---|
| FR | 2 416 988 | 9/1979 |

* cited by examiner

*Primary Examiner*—Winnie Yip
(74) *Attorney, Agent, or Firm*—Wood, Herron & Evans, L.L.P.

(57) ABSTRACT

A wood floor system comprises a plurality of parallel rows of floorboards laid end-to-end, and each of the floorboards includes a compression nub extending along a side surface thereof, adjacent the top surface. These compression nubs affirmatively engage an opposing side surface of an adjacent floorboard row, thereby sealing, or isolating, the top surface of the floor from the side surfaces of the floorboard rows. This uniformly distributes expansion and contraction forces throughout the floor, due to uniform spacing between the floorboard rows. The isolation of the upper floorboard surface from the side surface also prevents undesired downward migration or flow of liquid finishing solution, which can have serious adverse affects for a wood floor. The invention reduces the total volume of finishing solution necessary for finishing the floor, and it also reduces "overwood" during floor installation.

13 Claims, 2 Drawing Sheets

FLOORBOARD WITH COMPRESSION NUB

This application is a continuation of application Ser. No. 09/804,207, filed Mar. 12, 2001, abandoned which is a continuation of Serial No. PCT/US99/20835, filed Sep. 10, 1999 (expired) and claims the benefit of application Ser. No. 60/099,829, filed Sep. 11, 1998 (abandoned), the disclosures of which are fully incorporated herein by reference.

FIELD OF THE INVENTION

This invention relates to floorboards for hardwood floors, and more particularly, an elongated floorboard which promotes a uniform distribution throughout the floor of expansion and contraction due to moisture ontake and egress, which result from humidity changes in the environment.

BACKGROUND OF THE INVENTION

Hardwood floors are extremely popular for a wide variety of sporting activities and residential purposes. Hardwood floors provide an aesthetically appealing floor surface of stable and consistent construction.

Some types of wood floors or wood floor systems comprise a plurality of elongated floor strips laid end-to-end in parallel rows. Other types of wood floors, including those referred to as "parquet" floors, vary in layout somewhat from only parallel rows of floor strips. These other types of floor layouts may have various sections with floorboards arranged in longitudinal and transverse directions relative to a given space, or even arranged diagonally, or at another angle. Nevertheless, even with these other types of floor layouts, there are usually at least some portions of the floor wherein a plurality of end-to-end floor strips or boards reside in parallel rows.

This invention relates generally to wood floors wherein the entire floor or a portion of a floor has a plurality of floor strips laid end-to-end in parallel rows, but this invention is particularly advantageous for those floors wherein the entire floor comprises parallel rows of floorboards arranged along one direction.

Floors of this type typically have a tongue and groove construction to reinforce the individual floorboards and to facilitate stable securement of the floorboards to an underlying surface at the same desired vertical level. Once installed, the tongues and grooves along the longitudinal side surfaces of the floorboards help to stabilize the floor system so that no single floorboard or row of floorboards is able to move vertically relative to the rest of the floor. Typically, the elongated tongue and groove construction of such floorboards is cut into the side surfaces of the floorboards by a saw, and this is done by the floorboard manufacturer at the same time the top and bottom surfaces of the individual floorboards are formed. Parallel rows of floorboards are usually secured to an underlying subfloor or base, one row at a time, as the installer works his way across the floor.

It is well known among hardwood floor manufacturers and installers that wood building products, particularly elongated wood floorboards or floor strips, undergo expansion and contraction due to moisture ontake and egress, which result from humidity changes in the surrounding environment. With respect to a plurality of rows of parallel floorboards, almost all of this expansion and contraction occurs laterally, or transverse, to the longitudinal direction of the floorboards. There are even some hardwood floor systems, particularly those suited for athletic use, wherein the subfloor structure is specifically designed to permit lateral movement of the floorboards due to transverse expansion and contraction relative to an underlying base. U.S. Pat. No. 4,856,250 discloses such a floor.

Because of these expansion and contraction forces, installers of hardwood floors are required to place spacers between every few rows of floorboards. For example, washers having a width of about 3/16" every five, six or seven rows of a typical basketball floor comprising parallel rows of maple floor strips. This use of spacers in installing parallel rows of floorboards for a hardwood floor has been practiced for quite a long time. This practice is so well accepted that it is usually required in bid specifications or installation instructions for floors of this type. Typical spacers used by a floor installer are coin-like in shape, of uniform thickness, and they are placed between an already installed row of floorboards and the next layer of floorboards which is to be installed. The spacers limit or dictate the horizontal space between these two rows of floorboards. With a plurality of spacers of uniform width, this spacing should be uniform along the length of the two floorboard rows. Once the second row of floorboards has been installed at the desired spacing from the first row of floorboards, the spacers are removed. This leaves a spacer slot or seam of predetermined dimension.

This use of spacers in the hardwood floor industry represents an attempt to provide some degree of control over expansion and contraction of the floorboards, by providing some open space for lateral floorboard expansion every few rows of the floor. If such voids or spaces were not provided, expansion of tightly engaged parallel rows of floorboards due to humidity would invariably result in buckling of the floor at its weakest point. Stated another way, the spacers provide desired open spaces between every few rows of floorboards, thereby significantly reducing the occurrence of buckling of the floor. It is generally recognized in the hardwood floor industry that spacers of this type are necessary for proper installation of a hardwood floor, if it is desired to minimize the potential for buckling of the floor and to assure that the floor will have a long life.

However, the use of spacers in installing a hardwood floor system also creates a number of problems. For one thing, the need to locate the spacers between two rows of floorboards for every few rows of the floor, and then to subsequently remove the spacers represents a labor cost for the floor installer. Also, even though a floor installed with spacers is less susceptible to buckling than a typical floor installed without any spacers, those portions of the floor which reside between the spacer seams still have some potential for buckling even though there is little or no possibility for buckling along the spacer seam. In other words, the buckling potential for the floor is not uniform as one moves transversely across the rows of the floorboards.

To understand a number of additional disadvantages with the use of spacers, it is necessary to understand some common practices associated with installing and finishing a typical hardwood floor. Usually, after the floor has been secured to an underlying subsurface, the floor is first sanded and then it is finished with a liquid finishing solution. Currently, most liquid finishing solutions are oil based, but water based liquid finishes are becoming more popular, and are even required by law in some states due to environmental concerns. As an alternative to installing a floor and then sanding and finishing the already-installed floor at the use site, the floor may be prefinished at the manufacturing site and then shipped to the use site. When a floor is prefinished, it is temporarily laid out over a base, but it is not permanently fastened thereto. Thereafter, it is sanded, finished and then packaged for shipment to the installation site. Spacers are not necessary when the floor is temporarily laid out for refinishing at the manufacturer's site, but the spacers are typically used during permanent installation at the use site.

When the liquid finishing solution is applied to a floor, the liquid solution tends to migrate downwardly along the side surfaces of the rows of floorboards. This is true for prefinishing at the site of manufacturer or finishing at the use site. However, for the spacers for a floor finished at the installation site, the spacer seams are particularly susceptible to this situation. In fact, with such rows the downward liquid solution flow can more accurately be characterized as a waterfall rather than a migration of liquid solution.

When a water based finishing solution of this type moves downwardly between the side surfaces of parallel rows of floorboards, and perhaps even to the bottom surfaces of the floorboards, it eventually dries and adhesively bonds together the surfaces it is sandwiched between. This bonding effect has even been characterized as being similar to applying a "superglue" between the bonded surfaces. This bonding effect along the side surfaces of the floorboard rows tends to make the floor respond to expansion and contraction more like a monolithic structure than a plurality of parallel rows of floorboards, at least for some portions of the floor. In some instances, this bonding may result in preventing the floor from expanding into the voids created by the spacer seams. This is particularly true if the water based finished solution has migrated all the way to the bottom surfaces of the floorboards. As a result of the adhesive bonding caused by the water based finish, the floor can effectively become almost like a plurality of parallel monolithic floor portions separated by the spacer seams. When this occurs, subsequent significant contraction of the floorboards may cause the spacer seams to widen to the point where the floorboard tongues of these seams can be seen from above.

Although an oil based finishing solution does not usually have the same adhesive bonding effect of a water based finished solution, it also represents other disadvantages. For one thing, the oil based finish takes quite a significantly longer time to dry, and therefore may continue to reside along the side surfaces or even the bottom surfaces of the floorboards for some time after installation. Thereafter, any significant lateral expansion of the floorboards could cause the oil based finish to creep upwardly along the seams and onto the upper surface of the floor, resulting in an unsightly and potentially dangerous floor surface. Applicants are aware of at least one actual installed floor where this situation has occurred. Thus, the application of a liquid finish to a hardwood floor, i.e., whether water based or liquid based, has been known to generate problems with the long-term stability and/or appearance of the floor, particularly along spacer seams of the floor.

Another problem with installation of floors of this type is called "overwood." This term and situation refers to the amount of floorboard material which extends above a floorboard in an adjacent row. This may result from undesired expansion of the floorboards during prefinishing, or even some mismatching of the vertical levels of the tongue and groove of adjacently located floorboards. This may occur because it is common to precisely machine, or cut, the top surfaces of the floorboards, to assure the best fit on the top surface, but not necessarily the bottom and side surfaces. These side surfaces usually have lower tolerances. It is an object of the invention to reduce the time and costs associated with installing a hardwood floor which includes at least some parallel rows of elongated floorboards.

It is another object of the invention to more evenly distribute the lateral expansion and contraction forces to which a typical hardwood floor of this type is subjected, due to humidity changes.

It is still another object of the invention to eliminate the downward migration of finishing solution between side-by-side floorboard rows of a hardwood floor, and the serious problems associated therewith.

It is still another object of the invention to reduce the costs associated with applying a liquid finish to a hardwood floor.

It is still another object of the invention to minimize the amount of overwood between adjacent rows of floorboards of a wood floor.

SUMMARY OF THE INVENTION

The present invention achieves the above-stated objects via an elongated compression nub formed in one longitudinal side surface of an elongated floorboard, adjacent the top surface thereof, to positively engage an opposing surface of an adjacently located floorboard. This position engagement along the length of the floorboard rows provides a seal between the upper surface and the side surfaces. It also provides over a gap of predetermined dimension between the rest of the side surfaces of the floorboards.

If the floorboard includes a tongue along one longitudinal side surface and a groove along the other longitudinal side surface, the compression nub may reside above either the tongue or the groove, so long as it is adjacent the top surface. The invention further contemplates at least one additional longitudinal compression nub located below the uppermost compression nub, so that if the uppermost compression nub is sanded away during subsequent maintenance of the floor, the next compression nub will perform the same sealing, or isolating, function.

According to a preferred embodiment of the invention, a wood floor system comprises a plurality of parallel rows of elongated floorboards laid end-to-end, and each of the floorboards includes a first longitudinal side surface which has been formed with a relatively small compression nub for engaging the opposing surface of a floorboard in an adjacent row, relatively close to the upper surface. If the floorboards are tongue and groove floorboards, the compression nub resides well above the tongue or the groove, so that it resides relatively close to the upper surface of the floorboards.

This invention facilitates installation of a hardwood floor of parallel rows of elongated floorboard strips, i.e., a strip type floor, because the compression nubs along one elongated side surface of the floorboards assure accurate and repeatable spacing between adjacent rows of floorboards. This eliminates the need to locate and then remove spacers between every few rows of the floorboards, resulting in a reduction in time and costs in installing the floor system. Instead of having spacer seams located every few rows, as known from the prior art, this invention provides some relatively small spacing, as defined by the dimensions of the compression nub, between all adjacently located rows of the floor. This localizes expansion and contraction of the rows of the floorboards to a much greater degree than the use of spacer seams. It also eliminates the spacer seams or gaps.

Because there is a uniform and controlled amount of spacing between all of the adjacently located rows of floorboards, a hardwood floor of floorboards equipped with this feature has lateral expansion and contraction which is uniformly distributed throughout the rows of floorboards. Stated another way, the invention eliminates the isolation of rows of floorboards which must bear a disproportionate share of the lateral displacement due to moisture ontake or egress. These forces are more uniformly distributed.

Because the compression nubs of the rows of floorboards affirmatively engage the opposing side surface of an adjacent row of floorboards along the entire lengths of the floorboard rows, this invention prevents undesired downward flow or migration of liquid finishing solution along the opposing side surfaces of the floorboard rows. Since the compression nubs prevent downward migration of liquid finishing solution, the compression nubs also eliminate the undesired bonding caused by water based finishes, and the potential for subsequent upward migration of oil based finishes onto the floor surface.

With this invention, the volume of finishing solution which migrates downwardly beyond the surface of the floor is minimal, or virtually non-existent, because of the positive "seal" between adjacent rows of floorboards. This also produces a secondary benefit of reducing the time and costs associated with finishing a floor of this type. More specifically, there is only minimal loss of finishing solution between the rows of floorboards as it is applied to the floor surface. Thus, a lower volume of finishing solution is needed to adequately coat a given surface area of the floor, so the cost of finishing is reduced.

Further, according to the invention, the compression nubs are precisely machined to a desired shape and size, with at least the same degree of precision as the upper surfaces of the floorboards. This facilitates level and accurate installation of the floor, with little or no "overwood," particularly if the floor is prefinished.

These and other features of the invention will be more readily understood in view of the following detailed description and the drawings.

DETAILED DESCRIPTION OF THE DRAWINGS

Figure 1:
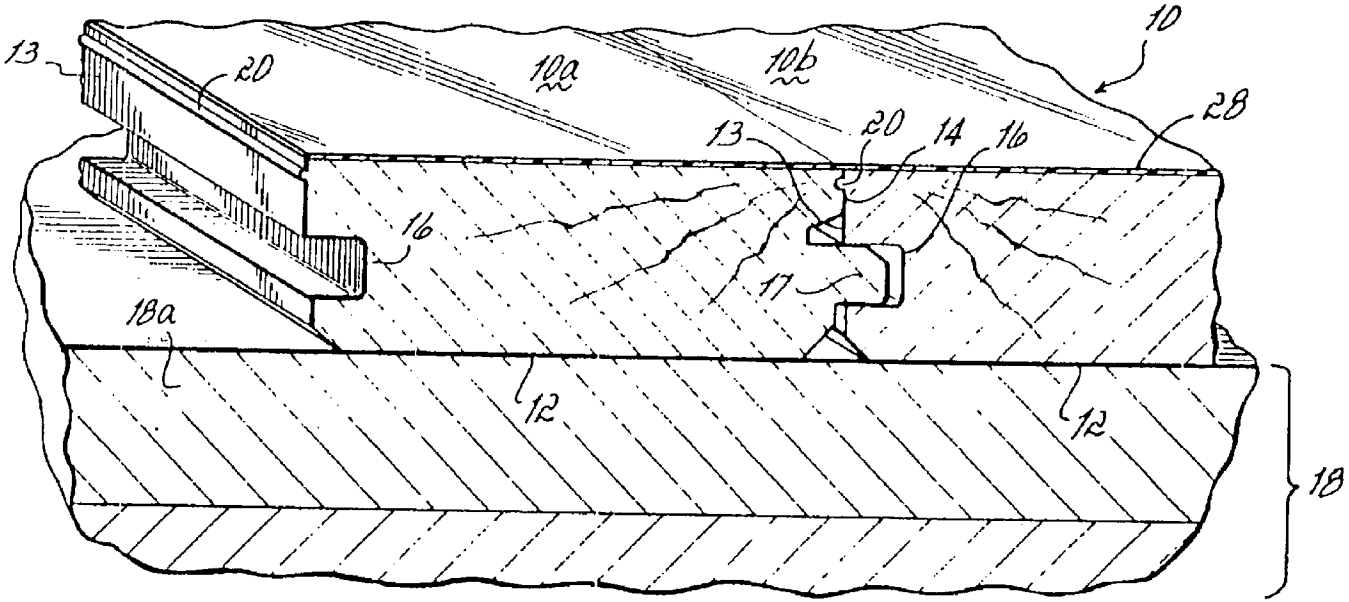
FIG. 1 is a perspective view, in partial cross-section, of a wood floor comprising floorboards constructed in accordance with a first preferred embodiment of the invention.

FIG. 1 shows a floorboard 10 constructed in accordance with a first preferred embodiment of the invention. The floorboard 10 includes an upper surface 11, a bottom surface 12, and a pair of side surfaces 13 and 14. Typically, the floorboard 10 is elongated and manufactured via a sawing process into the desired transverse cross-sectional shape, as shown in FIG. 1. The floorboard 10 also includes a longitudinal groove 16 and a longitudinal tongue 17 extending along opposite side surfaces, and if desired one or more spaced grooves (not shown) extending along the bottom surface 12. The particular cross-sectional configuration of the floorboard 10 depends upon a number of considerations, and the desired shape is produced by sawing, as is known in the industry. But the floorboard 10 may also be formed by machining, and other cross-sectional shapes may be desired.

The floorboard 10 resides in a first row 1O*a* which is located adjacent a second row, designated 10*b*, of identical floorboards 10. The floorboards 10 are laid end-to-end along parallel rows, such as 10*a* and 10*b*, . . . 10*z*, etc., for at least a portion of the floor, if not the entire floor. The floorboards 10 reside over a substructure 18, which in FIG. 1 is a subfloor layer 18*a* located above a base 18*b*. Other substructures 18 may be used, depending on a number of factors.

Figure 4:
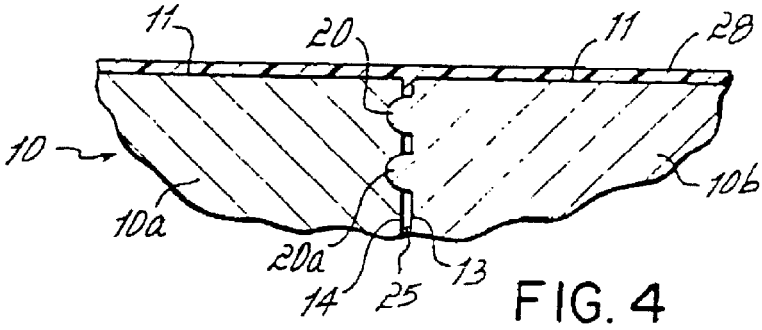

In accordance with the invention, the floorboards 10 include a compression nub 20 extending longitudinally along one of the side surfaces. In FIG. 1, the compression nub 20 extends along the side surface 13 which includes the groove 16, but it is to be understood that the compression nub 20 could just as easily be formed in the side surface 14 which resides above the tongue 17. The compression nub 20 is preferably formed by machining, and is semicircular in cross-sectional shape with a radius in the range of about 6 to 10 thousandths of an inch, although the invention contemplates other particular sizes and shapes for the compression nub 20, so long as they are capable of achieving the desired purpose of sealing or isolating the top surface 11 from the side surfaces 13 and 14. The compression nub 20 preferably extends along the entire length of the floorboard 10, with no discontinuities, and a top end of the compression nub 20 is located proximate to the upper surface 11, well above the groove 16 and the tongue 17, i.e., in the range of about 20 to 50 thousandths of an inch, and preferably about 30 or 40 thousandths of an inch. The invention further contemplates at least one or more additional compression nubs 20*a*, as shown in FIG. 4, extending along one of the longitudinal side surfaces. If one or more such compression nubs 20 are used, the additional compression nubs 20*a* should also be as close to upper surface 11 as possible.

For some hardwood floors, the floor is comprised entirely of rows of floorboards 10 laid end-to-end in parallel rows. All of the floorboards 10 have the same transverse cross-sectional shape, but the floorboards 10 may vary in length if desired, preferably with the end-to-end seams of the floorboards 10 in any given row offset, i.e., not in alignment with, end-to-end seams of floorboards 10 in an adjacent row. Using random lengths for the floorboards 10 facilitates this offsetting effect.

When a hardwood floor is installed using floorboards 10 which have a compression nub 20, the compression nub 20 engages the opposing surface of an adjacently located floorboard row along the entire length of the row. For the floorboards 10 of the type shown in FIG. 1, the compression nub 20 engages side surface 14, located above the tongue 17. The side surface 14 is typically sawed so as to be generally flat and vertical in orientation.

Figure 2:
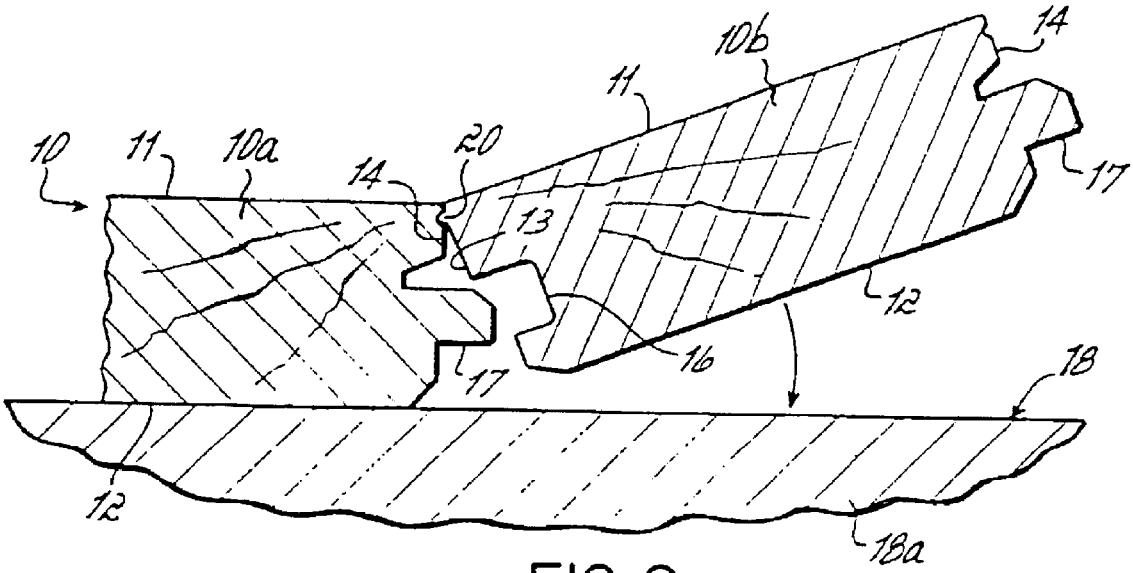
FIG. 2 is a cross-sectional view which shows installation of a row 10*b* of floorboards adjacent to an already installed row 10*a*.
Figure 3:
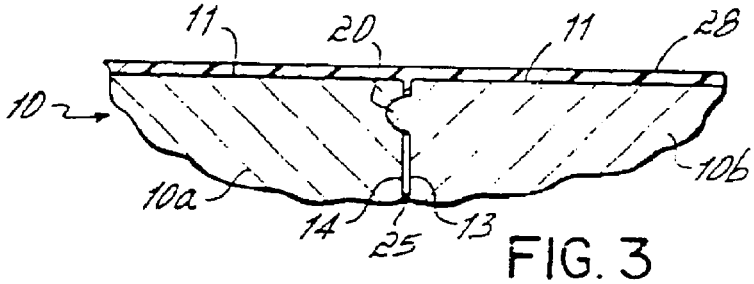
FIGS. 3 and 4 are enlarged cross section views which illustrate the principle of the invention, for first and second variations of the invention.

With the compression nub 20 extending from a first surface 13 of a floorboard 10 in a first row 10*b* of the hardwood floor and engaging an adjacently located second surface 14 of an adjacent row 10*a* of floorboards, the adjacently located floorboard rows 10*a* and 10*b* are spaced a desired lateral distance from each other, as dictated by the horizontal dimension of the compression nub 20. This is best shown in FIGS. 2, 3, and 4, with space 25 residing between rows 10*a* and 10*b* in FIGS. 3 and 4. The compression nub is sufficiently small so as to be compressible and the surface 14 is somewhat deformable that this combination of compressibility of the compression nub 20 and deformability of the surface 14 enables the adjacently located floorboard rows 10*a* and 10*b* to expand toward each other slightly into this small space 25. Thus, the compression nub 20 allows lateral expansion between all of the rows 10*a*, 10*b* . . . 10*z* of the floorboards. Because the compression nubs 20 space all of the rows 10*a*, 10*b* . . . 10*z* of floorboards 10 the same distance from each other, the expansion is evenly distributed across the entire floor. Because these expansion spaces 25 are "built in," no spacers are needed to provide periodic spacer seams between adjacent floorboard rows. Thus, there is no need to locate and then remove spacers every few rows. The compression nubs 20 localize the expansion between all of the rows of floorboards 10.

Because the compression nub 20 affirmatively engages the opposing side surface of an adjacently located floorboard along the entire length of the floorboard rows 10*a*, 10*b*, . . . 10*z* when a liquid finish is applied to the floor, as indicated by reference numeral 28 in FIGS. 3 and 4, it is blocked from migrating downwardly between the adjacent rows of floorboards. For water based liquid finishing solutions, the compression nub 20 eliminates the bonding effect between the floorboards 10 of adjacent rows, and bonding of floorboards 10 to the substructure 18. For oil-based liquid finishes, compression nub 20 prevents downward migration and the potential for subsequent upward migration of the oil-based finish onto the floor surface. This is particularly advantageous for hardwood floors which are sanded and finished after installation, because the compression nub 20 eliminates the possibility of the liquid solution pouring downwardly into these spacer seams during application of the liquid finish. Thus, the floorboard 10 of this invention overcomes significant disadvantages with hardwood floors which are finished on-site.

The compression nub 20 also provides notable advantages for a hardwood floor system which is prefinished by the manufacturer prior to shipment to the installation or use site. This is due to the fact that during prefinishing the floorboards 10 are temporarily laid end-to-end in parallel rows and held in secure contact with each other. Invariably, at least some lateral force occurs along the side surfaces of the floorboards, either due to expansion or secure holding of the temporarily held floors. These lateral forces cause compression of the compression nub 20 and also a slight deformation or indentation into the adjacently located second side surface 14. Thereafter, the floorboards 10 are packaged and shipped to the installation site, and then sorted out at the installation site and located on a substructure 18 at the installation site. During installation, the nubs 20 will seat into the corresponding complementary-shaped indentations in the surfaces 14, to thereby affirmatively locate the adjacent rows of floorboards 10 at the same vertical level. This virtually eliminates the undesired condition of "overwood," a term used in the flooring industry to refer to one floorboard row extending vertically above an adjacently located row. Many floorboards are susceptible to overwood because side and bottom surfaces may not be sawed or machined as precisely as the top surface. By providing a precision machined compression nub 20 which seats within a complementary shape in the adjacently located surfaces 13 and 14, each row 10*a*, 10*b* . . . 10*z* of floorboards 10 can be permanently secured at the installation site at a desired vertical level relative to the already installed floorboard rows. This is best illustrated in FIG. 2 where row 10*a* is already installed and row 10*b* is being moved downwardly and arcuately into position alongside thereof.

Figure 5:
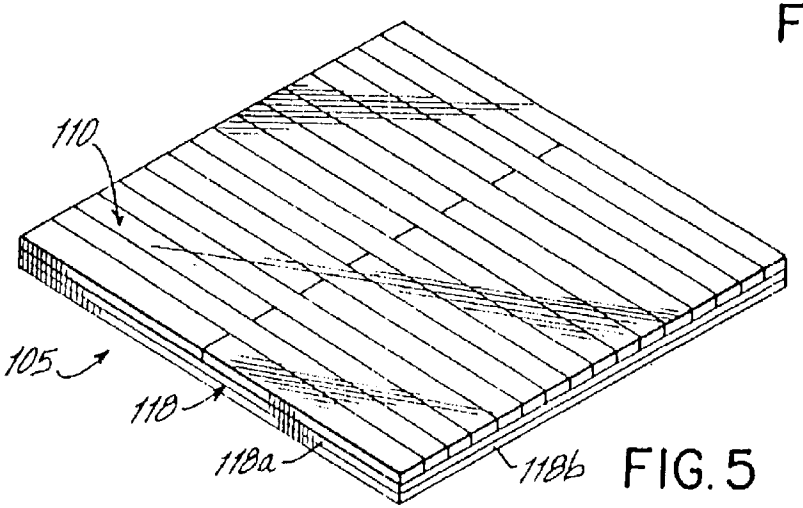
FIG. 5 is a perspective view which shows a second preferred embodiment of the invention.

FIG. 5 shows a second preferred embodiment of the invention. More specifically, FIG. 5 shows a floor section 105 which may be secured or laid above a base (not shown) in a desired pattern along with a plurality of similar sections 105 in order to create a wood floor. In FIG. 5, the floor section 105 includes a substructure 118, which in this case includes an upper subfloor 118*a* and a lower subfloor 118*b*, of material such as plywood and a plurality of floorboards 110 secured thereto in parallel orientation, i.e., with the rows designated via reference numerals 110*a*, 110*b*, . . . 10*z*. The adjacently located rows 110*a*, 10*b* . . . 10*z* may include tongue and groove constructions, although this is not necessary. Each of these rows 110*a*, 110*b*, . . . 10*z* has a compression nub 120 extending along one side surface thereof. With this embodiment of the invention, the compression nubs 120 provide the same advantageous features as described above with respect to the compression nub 20 of FIGS. 1–4.

While two preferred embodiments of the inventions have been shown and described, those skilled in the art will appreciate that the invention is subject to various other modifications without departing from the full scope of the invention. Applicants wish to be limited only be the following claims.

We claim:

1. A floor comprising:

a plurality of rows (10*a*, 10*b* . . . 10*z*) of side by side floorboards (10) which are interconnected along longitudinal edges by a plurality of tongue (17) and groove (16) connections, the floorboards (10) having upper surfaces defining a floor surface, at least some of the tongue (17) and groove (16) connections including:

a tongue (17) extending longitudinally along a first edge (14) of a first floorboard (10*a*) and a groove extending along an opposing second edge (13) of a second floorboard (10*b*), the tongue (17) sized to be received within the groove (16), the first (14) and second (13) edges being generally vertical along upper portions thereof located above the tongue and groove connection, wherein one of the first (14) and second (13) edges has an integral compression nub (20) spaced below the floor surface and protruding outwardly from the upper portion thereof and extending uninterrupted along the longitudinal edge of said one of the first (14) and second (13) edges, the compression nub (20) contacting the other of the first (14) and second (13) edges along the tongue (17) and groove (16) connection, whereby contact between the first (10*a*) and second (10*b*) floorboards along the compression nub (20) isolates the tongue (17) and groove (16) connection from the floor surface above and forms a space (25) between the first (14) and second (13) edges for localizing expansion and contraction between the rows of the floorboards and creating a seal therebetween, a base, and a substructure (18) supporting the plurality of rows (10*a*, 10*b* . . . 10*z*) of side-by-side floorboards (10) above the base.

2. The floor of claim 1 wherein the compression nub (20) of each of the floorboards (12) is located nearer the top surface than the tongue (17) or groove (16).

3. The floor of claim 1 wherein the compression nub (20) of each of the floorboards (10) is semi-circular in transverse cross-sectional shape and has a radius in the range of about 6 to 10 thousandths of an inch.

4. The floor of claim 1 wherein a top end of the compression nub (20) for each of the floorboards (10) is in the range of about 20–50 thousandths of an inch from the top surface.

5. The floor of claim 1 and further including at least one additional compression nub (20*a*) residing below said compression nub (20) for each of the floorboards (10).

6. A floor comprising:

a base;

an elongated strip (10) having generally flat top and bottom surfaces and first (14) and second (13) side surfaces, the bottom surface being attached over the base, wherein the first (14) and second (13) side surfaces includes a tongue (17) and groove (16) connection; and an integral compression nub (20) spaced below the top surface and protruding outwardly from one of the first (14) and second (13) side surfaces along substantially the entire length of the strip (10), the compression nub (20) spaced vertically above the tongue (17) and groove (16) connection from the bottom surface and relative to the base, the first (14) and second (13) side surfaces being oriented parallel with each other between the compression nub (20) and the top surface, wherein the compression nub (20) is compressively contactable with the other one of the first and the second side surfaces of an adjacent elongated strip, and the compression nub (20) forms a space between the first (14) and second (13) surfaces of two adjacent elongated strips for localizing expansion and contraction between the elongated strips and creating a seal therebetween.

7. The floor of claim 6 wherein the tongue (17) and the groove (16) extend longitudinally.

8. The floor of claim 6 wherein the compression nub (20) is semi-circular in transverse cross-sectional shape and has a radius in the range of about 6 to 10 thousandths of an inch.

9. The floor of claim 6 wherein a top end of the compression nub (20) is in the range of about 20–50 thousandths of an inch from the top surface.

10. The floor of claim 6 and further including at least one additional compression nub **(20*a*) residing below said compression nub (20)**.

11. A floor comprising a plurality of parallel rows **(10*a*, 10*b* . . . 10*z*) of floorboards (10), wherein the floorboards (10) are described by claim 6**.

12. A floor of a plurality of floor sections (105) arranged in a desired pattern over the base, each of the floor sections (105) including a substructure (118) and a plurality of parallel rows **(10*a*, 10*b* . . . 10*z*) of floorboards secured to the substructure (118), the floorboards being described by claim 6**.

13. A floor of a plurality of floor sections (105) arranged in a desired pattern over the base, each of the floor sections (105) including a substructure (118) and a plurality of parallel rows **(10*a*, 10*b* . . . 10*z*) of floorboards secured to the substructure (118), the floorboards being described by claim 7**.

* * * * *

UNITED STATES PATENT AND TRADEMARK OFFICE

CERTIFICATE OF CORRECTION

PATENT NO. : 6,851,237 B2
DATED : February 8, 2005
INVENTOR(S) : Michael W. Niese and Paul Elliott It is certified that error appears in the above-identified patent and that said Letters Patent is hereby corrected as shown below:

Column 5,
Line 64, please delete the numeral "1Oa" and replace it with -- 10a --.

Column 7,
Line 66, please delete the phrase "numerals 110a, 110b, … 10 z." and replace it with -- numerals 110a, 110b, … 110z. --

Signed and Sealed this

Fourteenth Day of June, 2005

JON W. DUDAS
*Director of the United States Patent and Trademark Office*